US009511270B2

(12) United States Patent
Berebitsky

(10) Patent No.: US 9,511,270 B2
(45) Date of Patent: Dec. 6, 2016

(54) BASKETBALL SHOT ACCURACY TRAINING SYSTEM

(71) Applicant: PHD SPORTS, LLC, Indianapolis, IN (US)

(72) Inventor: Jeff Berebitsky, Indianapolis, IN (US)

( * ) Notice: Subject to any disclaimer, the term of this patent is extended or adjusted under 35 U.S.C. 154(b) by 0 days.

(21) Appl. No.: 14/729,119

(22) Filed: Jun. 3, 2015

(65) Prior Publication Data

US 2015/0352422 A1 Dec. 10, 2015

Related U.S. Application Data

(63) Continuation-in-part of application No. 14/242,267, filed on Apr. 1, 2014.

(51) Int. Cl.

*A63B 69/00* (2006.01)
*A63B 63/08* (2006.01)
*A63B 63/00* (2006.01)

(52) U.S. Cl.

CPC ..... *A63B 63/083* (2013.01); *A63B 69/0071* (2013.01); *A63B 2063/001* (2013.01); *A63B 2208/0204* (2013.01); *A63B 2210/50* (2013.01); *A63B 2225/093* (2013.01)

(58) Field of Classification Search

CPC .. A63B 63/08; A63B 71/023; A63B 68/071; A63B 63/083; A63B 67/002; A63B 2063/001; A63B 2224/093; A63B 2208/12; A63B 69/407; A63F 9/02

USPC ..... 473/422, 433, 434, 447–449, 479–489; D21/702; 273/400

See application file for complete search history.

(56) References Cited

U.S. PATENT DOCUMENTS

| | | | | | |
|---|---|---|---|---|---|
| 532,132 | A | | 1/1895 | Zaremba | |
| 1,211,379 | A | | 1/1917 | Maisch | |
| D110,225 | S | | 6/1938 | Schutt | |
| 2,194,779 | A | | 3/1940 | Frank | |
| 2,278,616 | A | | 4/1942 | Kettering | |
| D139,311 | S | | 10/1944 | Gibson | |
| 2,379,572 | A | * | 7/1945 | Gibson | A63B 63/083 473/483 |
| 3,017,183 | A | | 1/1962 | Chalcroft | |
| 3,025,058 | A | * | 3/1962 | Brumfield | A63B 63/083 473/483 |
| 3,134,594 | A | | 5/1964 | Crowley | |
| 3,421,764 | A | | 1/1969 | Smith et al. | |
| 3,602,504 | A | * | 8/1971 | Chapman | A63B 63/083 473/416 |
| 3,602,505 | A | | 8/1971 | Friend | |
| 4,611,812 | A | | 9/1986 | Morrison | |
| D299,041 | S | | 12/1988 | Thornell | |

(Continued)

*Primary Examiner* — Mitra Aryanpour
(74) *Attorney, Agent, or Firm* — C. John Brannon; Brannon Sowers & Cracraft PC

(57) ABSTRACT

A basketball training aid kit, including a support base having a flat bottom portion and a central annulus for receiving a pole portion—the pole including an inner pole, an outer pole surrounding the inner pole, and a gas spring disposed inside and connectable to the inner pole and the outer pole—and a goal portion including a generally hollow cylindrical member defining an endless sidewall and an open end for receiving the inner pole, a plurality of support members extending from the endless sidewall, a plurality of goal portion apertures formed through the endless sidewall, and a netted hoop operationally connectable to the plurality of support members. A plurality of fasteners attach the pole portion to the bottom portion and the goal portion. The gas spring urges the goal portion upwards. Other implementations include height adjusters, fastening pole segments, couplers, padded skirts, and/or ball returns.

9 Claims, 13 Drawing Sheets

(56) References Cited

U.S. PATENT DOCUMENTS

| | | | | |
|---|---|---|---|---|
| 5,348,290 | A * | 9/1994 | Matherne | A63B 69/0071 473/433 |
| D351,880 | S | 10/1994 | Taylor et al. | |
| 5,810,679 | A | 9/1998 | Yoakum | |
| 6,692,385 | B2 | 2/2004 | Walker et al. | |
| 7,008,337 | B2 | 3/2006 | Kershaw | |
| 7,357,760 | B1 * | 4/2008 | Rios | A63B 69/345 473/444 |
| 2002/0187862 | A1 | 12/2002 | Benoit | |
| 2003/0190981 | A1 | 10/2003 | Walker et al. | |
| 2004/0204269 | A1 | 10/2004 | Micro et al. | |
| 2015/0273298 | A1 * | 10/2015 | Berebitsky | A63B 69/0071 473/433 |
| 2015/0352422 | A1 * | 12/2015 | Berebitsky | A63B 63/083 473/485 |

* cited by examiner

BASKETBALL SHOT ACCURACY TRAINING SYSTEM

CROSS-REFERENCE TO RELATED APPLICATIONS

This application is a continuation-in-part application of, and claims priority to, co-pending U.S. patent application Ser. No. 14/242,267, filed on Apr. 1, 2014. The disclosure of the foregoing application is incorporated herein by reference in its entirety.

BACKGROUND

The game of basketball has not fundamentally changed since its invention by Dr. James Naismith in 1891. Although the peach basket basketball goals of Dr. Naismith's day have given way to basketball goals incorporating engineered breakaway rims and materials engineered backboards, the objective of the game has remained fundamentally the same. Points are still awarded for shooting a basketball through the basketball goal or hoop.

It is axiomatic that a player using proper basketball shooting technique will successfully shoot a basketball through the basketball goal more frequently than will a player using inferior or poor technique. It is common knowledge that a basketball approaching the basket at a low or flat trajectory is less likely to successfully pass through the hoop than does a basketball approaching the basketball goal at a higher or more lofted trajectory. Thus, one component of proper basketball shooting technique is the ability to impart a properly lofted trajectory on the thrown basketball.

Several attempts have been made to develop a basketball training device which, through repetitive use, will assist a player in developing the muscle memory required to impart the desirable lofted trajectory on his or her basketball shots. Such devices include a second hoop positioned between the shooter and the basketball goal hoop, in an attempt to break the shot down into component parts. However, this device suffers from the drawback of redirecting the player's attention away from the goal, reinforcing bad form insofar as the player is trained to look elsewhere from where he is shooting.

Another basketball training device comprises a circular or elliptical member that is mounted to or above the basketball goal. The plane including the circular or elliptical member forms an acute angle with respect to the plane including the basketball goal. The object this device is to shoot the basketball such that it passes first through the acutely angled circular or elliptical member, and then through the horizontally oriented basketball goal. The acutely angled circular or elliptical member is positioned along the shooter's desired trajectory. Through repetitive use, such a basketball training device will assist a basketball shooter in developing the muscle memory required to impart the desirable lofted trajectory on his or her basketball shots. However, these kinds of devices possess the disadvantages that they must be positioned directly between the shooter and the basketball goal during use, so it must be repositioned each time the shooter wishes to change positions on the basketball court from which he or she is practicing.

Another basketball training device involves the use of a barrier over which a basketball shot must be lofted in order to pass through the basketball goal. Devices of this type typically include circular or a semi-circular member connectible to a backboard and having a radial dimension larger than the basketball goal. The plane including the semi-circular member is typically parallel to the plane including the basketball goal. While helpful, these types of devices inherently include the backboard, and thus encourage shots that bank the basketball off the backboard and into the goal. Also, the efficacy of such training devices is limited to players positioned more or less directly in front of the backboard. Still further, such devices require a backboard already present, such as in a gym or at a park.

Thus, there remains a need for an improved basketball shot training device that may be used in more universal locations and that is not limited to the requirement of a backboard. The present novel technology addresses this need.

DETAILED DESCRIPTION

Figure 1A:
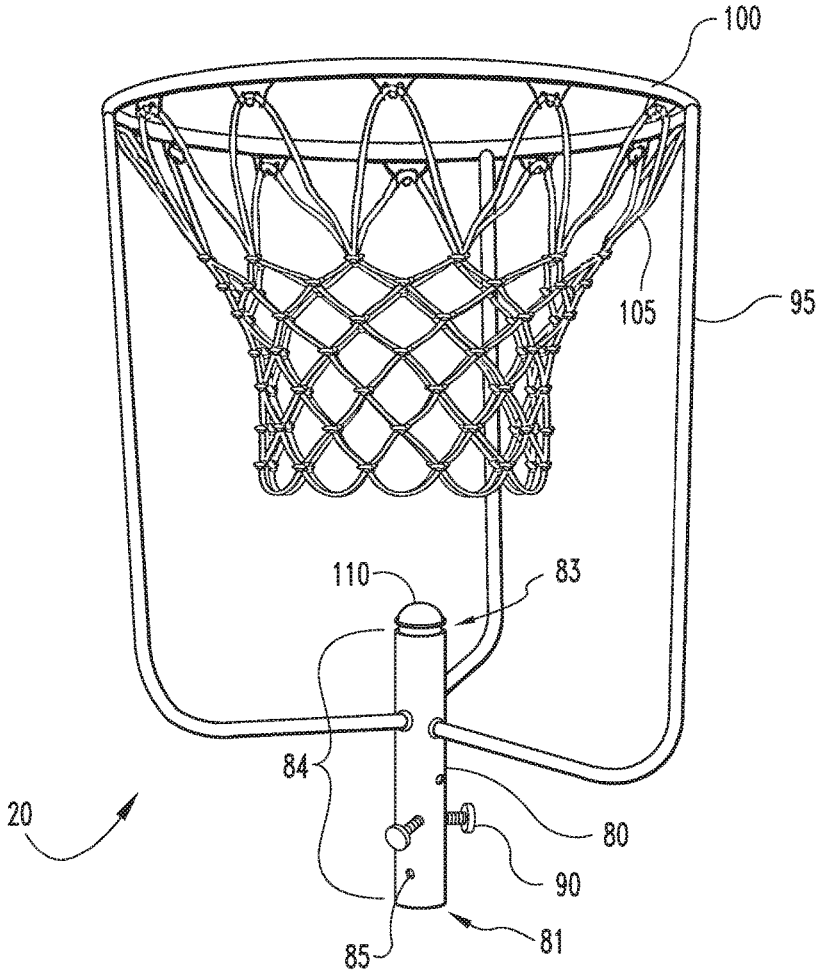
FIG. 1A shows a first perspective view of a goal assembly according to one embodiment of the basketball training aid of the present novel technology.
Figure 1B:
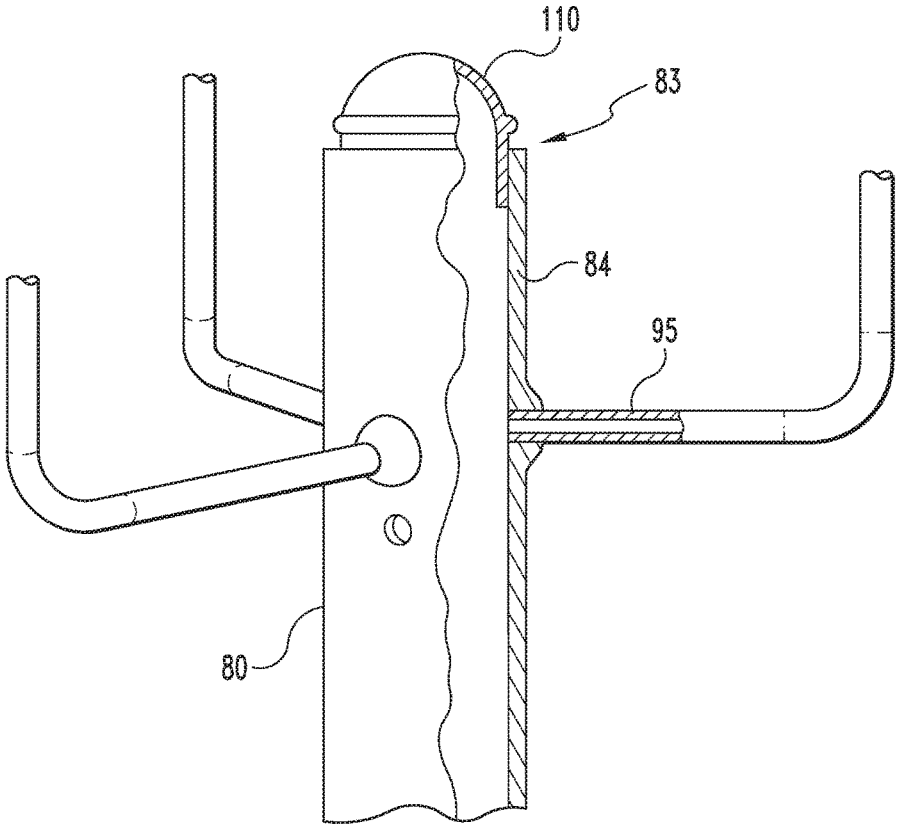
FIG. 1B is an enlarged partial perspective view of FIG. 1A.
Figure 1C:
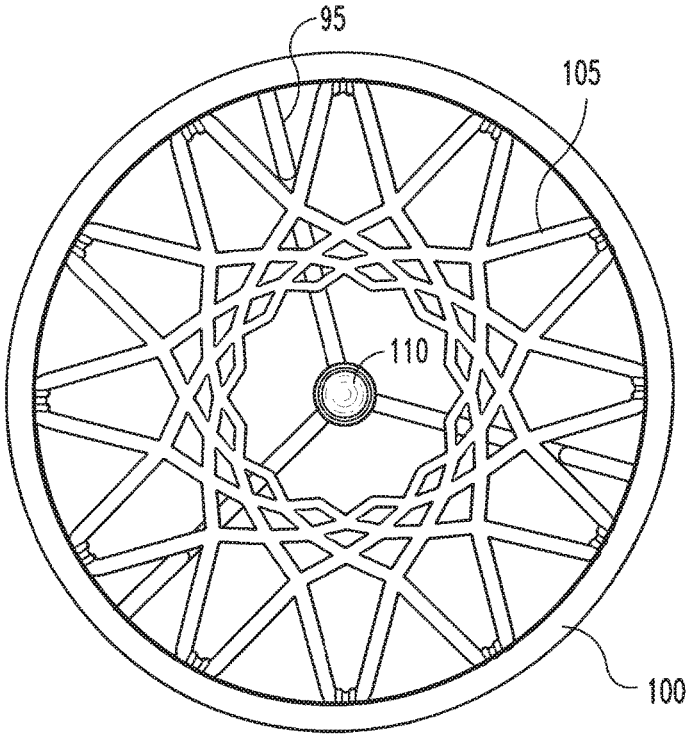
FIG. 1C is a top plan view of FIG. 1C.
Figure 2:
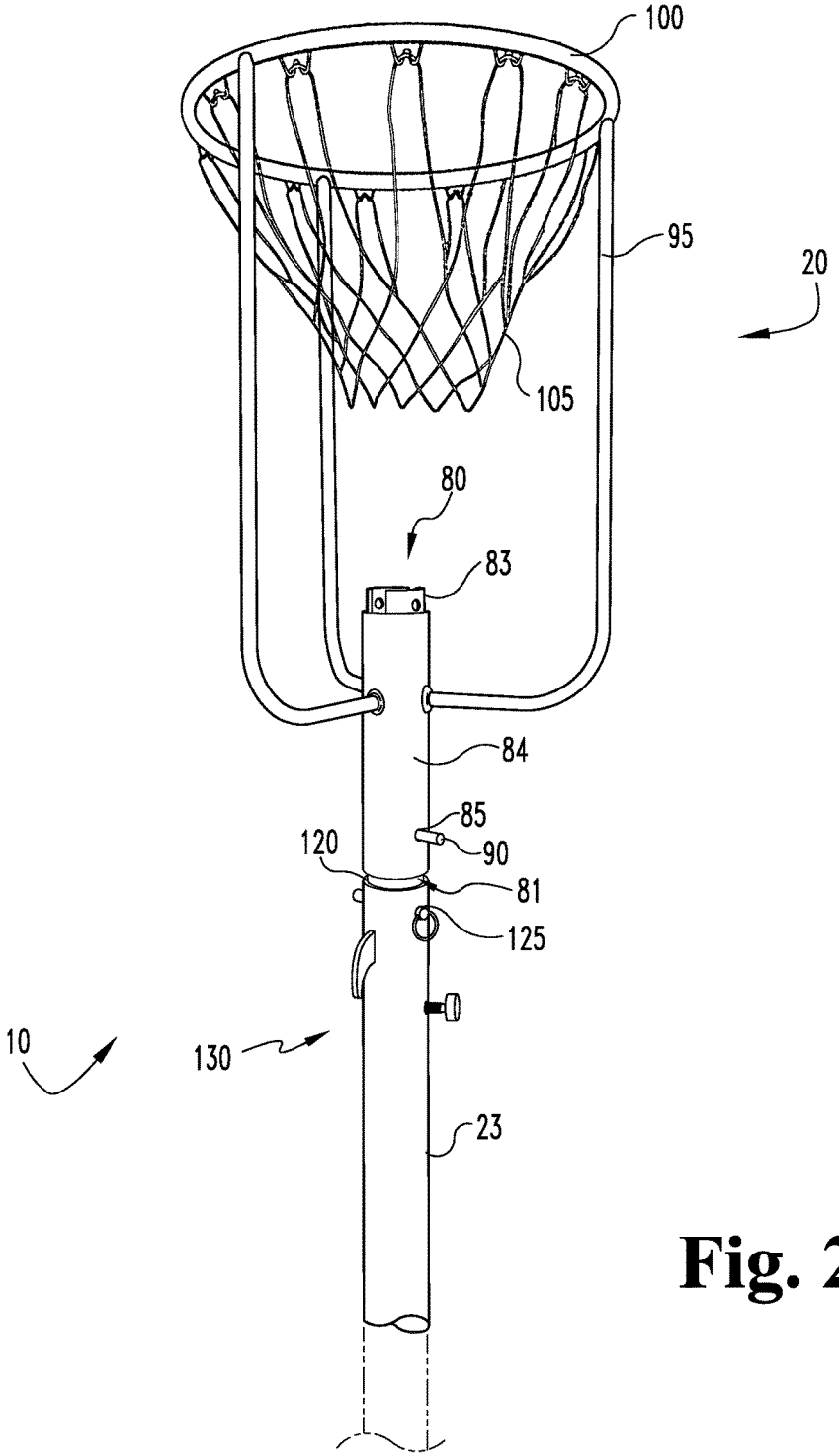
FIG. 2 is a partial perspective view of FIG. 1A as attached to a pole.
Figure 3:
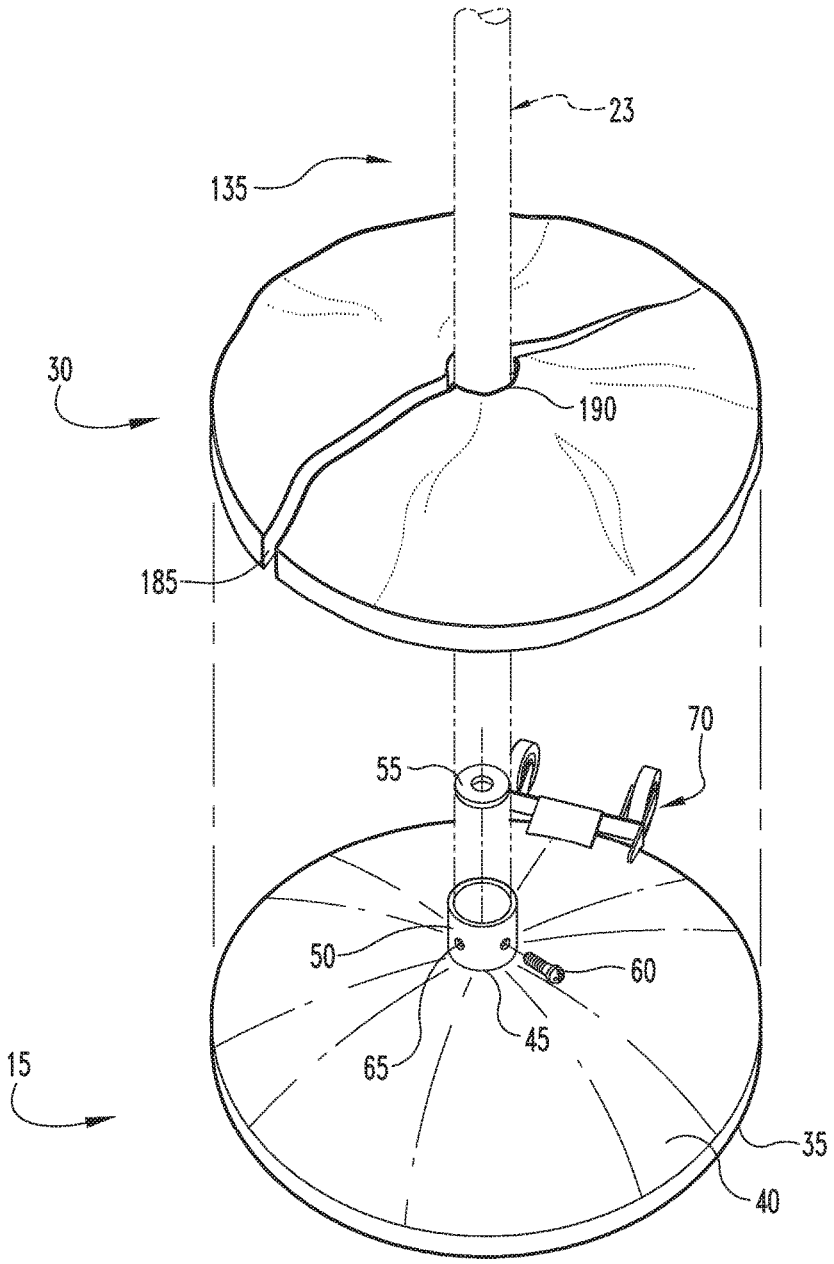
FIG. 3 is a partial perspective view of a base portion according to the embodiment of FIG. 1 as attached to a pole.
Figure 4:
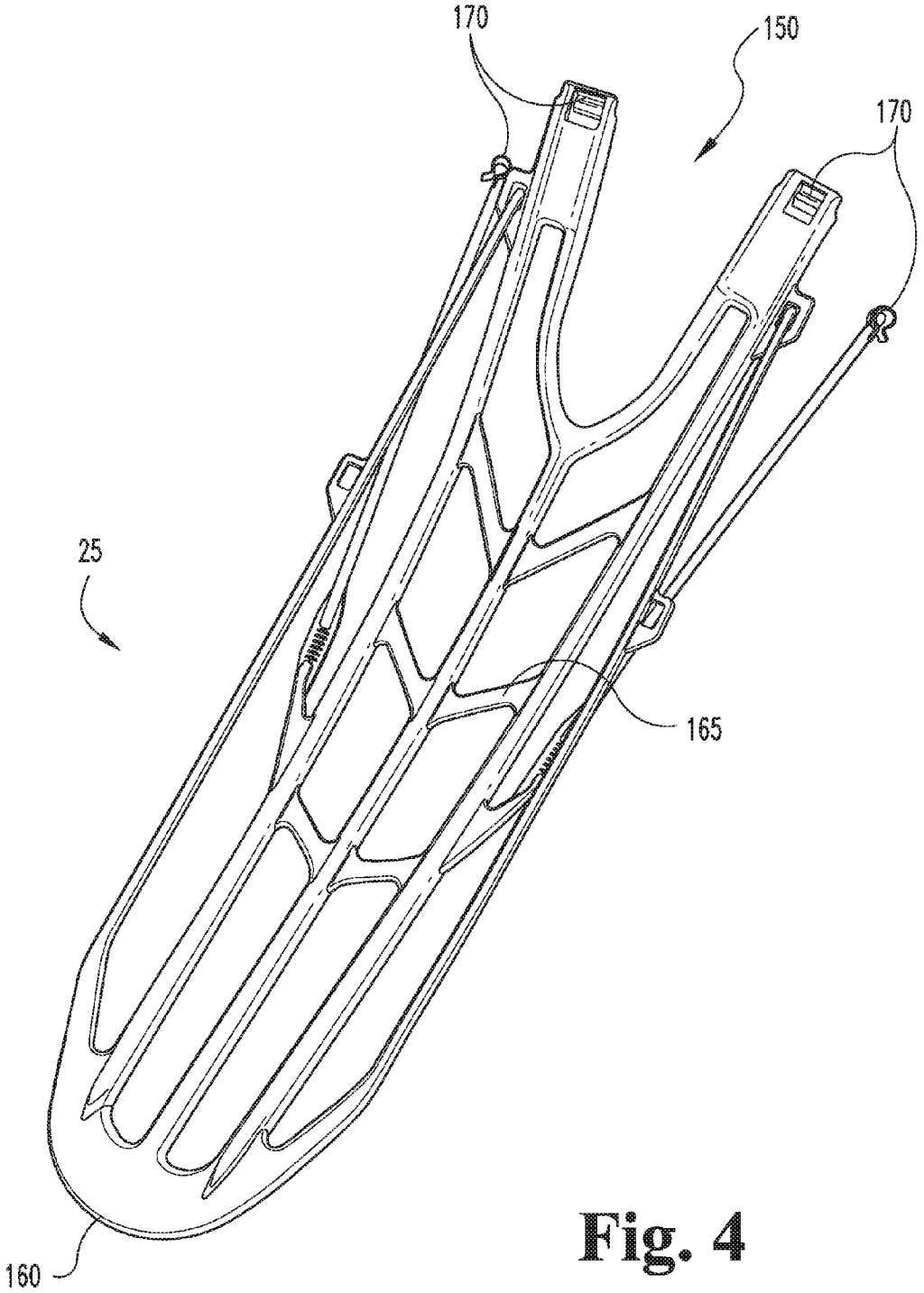
FIG. 4 is a perspective view of a return member according to the embodiment of FIG. 1A.
Figure 5:
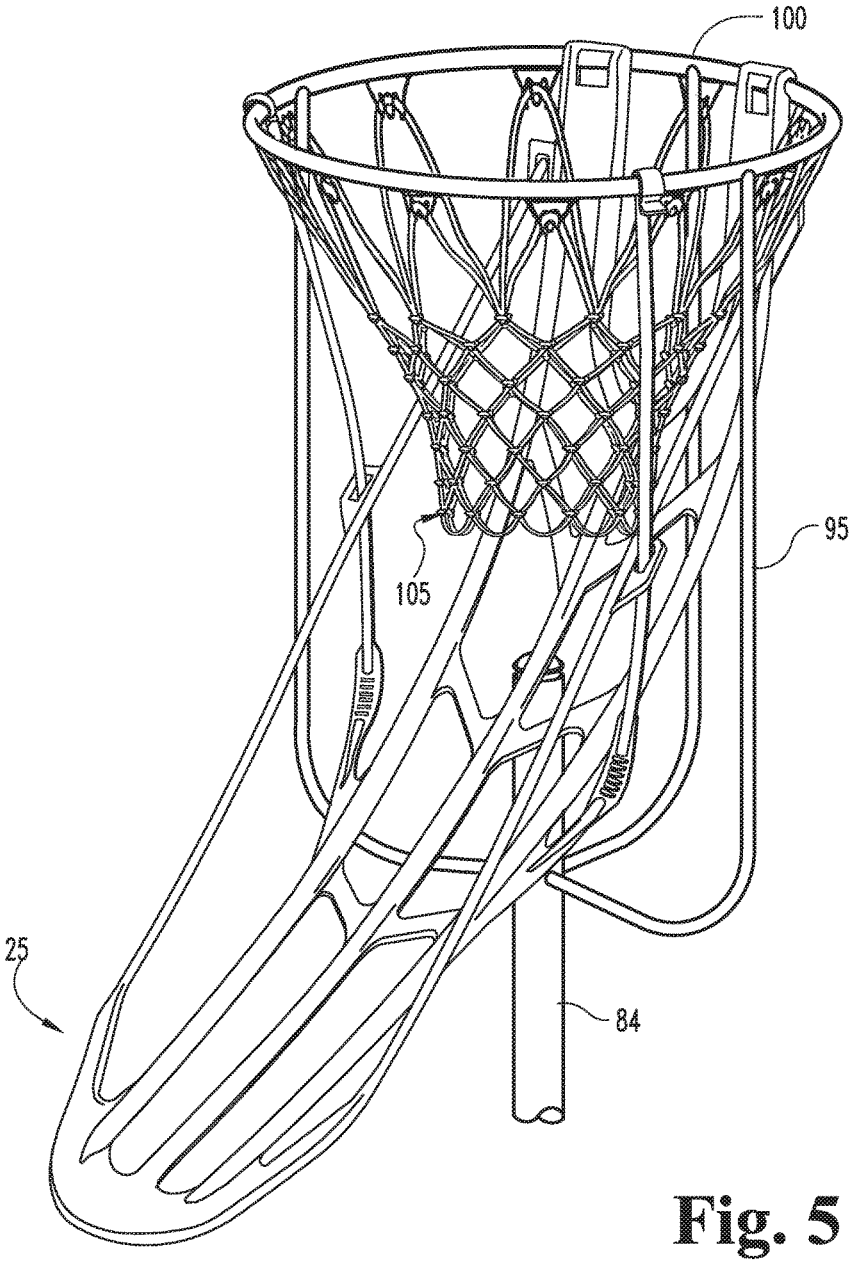
FIG. 5 is a perspective view of a cover member according to the embodiment of FIG. 1A.
Figure 6:
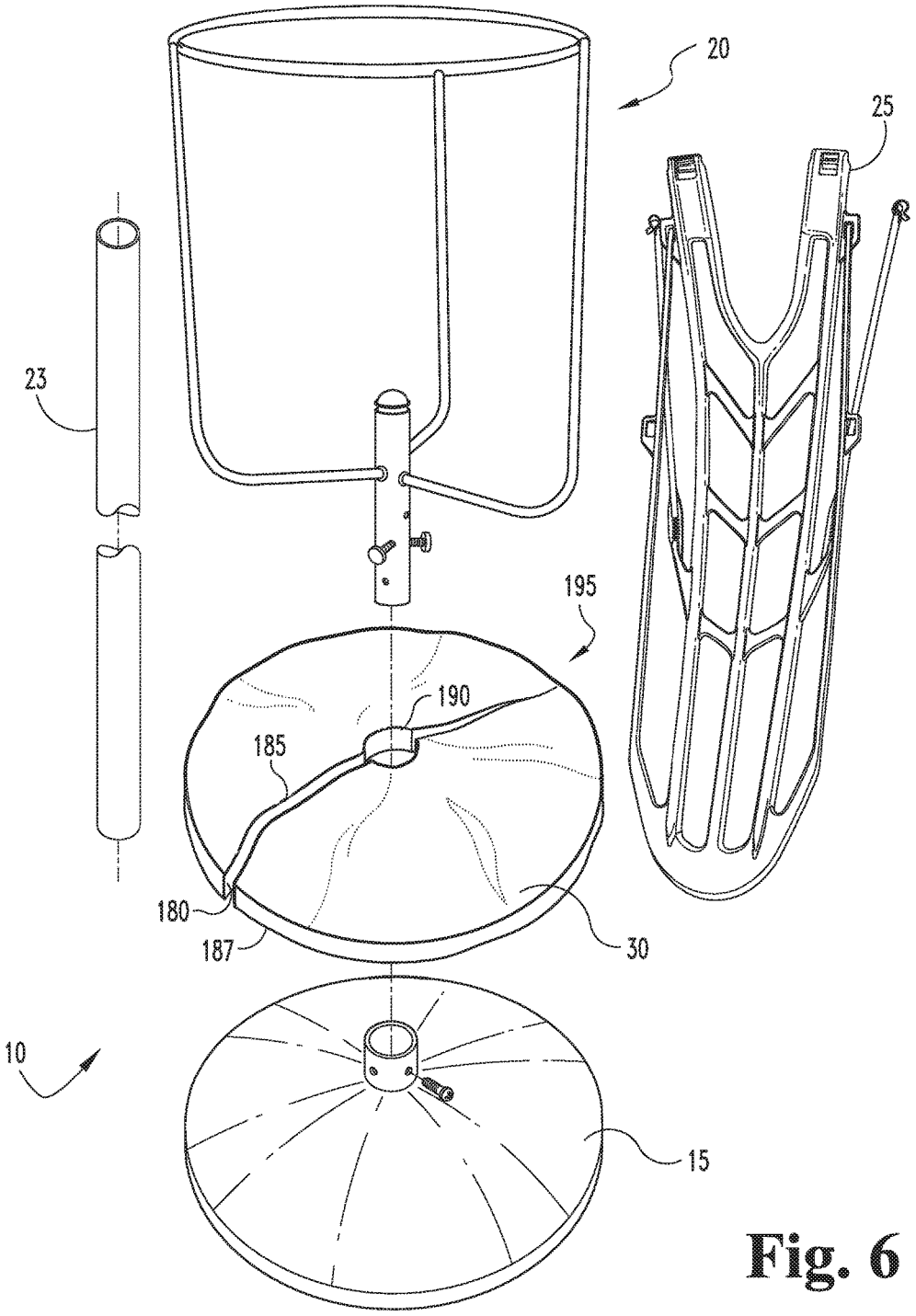
FIG. 6 is a perspective view of the kit members according to the embodiment of FIG. 1A.

For the purposes of promoting an understanding of the principles of the novel technology, reference will now be made to the embodiments illustrated in the drawings and specific language will be used to describe the same. It will nevertheless be understood that no limitation of the scope of the novel technology is thereby intended, such alterations and further modifications in the illustrated device, and such further applications of the principles of the novel technology as illustrated therein being contemplated as would normally occur to one skilled in the art to which the novel technology relates.

FIGS. 1-6 relate to a first embodiment of the present novel technology, a basketball shot training system 10 including a base portion 15, a goal portion 20, an optional pole portion 23, a ball return guide portion 25, and an optional base guard portion 30.

The base portion 15 (also referred to as a circular support base portion and the like) is typically a circular or oval member having a generally flat bottom portion 35 (also referred to as a flat bottom member, bottom member, and the like) covered by a generally convex or raised top portion 40

(also referred to as top member). An aperture 45 is formed in the top portion for receiving an elongated member. The aperture 45 is typically located near the center or middle of the top portion 40. Typically, an annulus or hollow cylindrical tube 50 extends from the aperture 45 for securely receiving and supporting an elongated member, such as a pole (also referred to as an elongated pole member, elongated pole, extendable pole, pole portion, and the like). An annular adapter insert or ring 55 may be provided to reduce the effective inner diameter of the cylindrical tube 50 or aperture 45, wherein the ring 55 has an outer diameter sized to fit within the tube 50 or aperture 45 with a smaller inner diameter. The cylindrical tube 50 typically includes one or more apertures 65 formed therethrough for receiving locking members 60 that may be inserted to hold an elongated member extending through the aperture 45 and/or tube 50 in place. Typically, the apertures 65 and locking members 60 are matably threaded. In some embodiments, one or more wheels 70 may be operationally connected to the top portion 40 and angled such that the wheels engage the ground when the top portion 40 is tilted toward the wheels 70.

The base portion 15 is typically made of a structural material, such as aluminum, steel, composite material, or plastic. The bottom portion 35 typically includes a resilient or pliable layer 73, such as a rubber pad or footing. The bottom portion 35 typically is sized to cover sufficient surface area to stabilize the system when in use (i.e., against the impact of basketballs thrown at the rim 100), more typically at least 0.6 square meters (6.7 square feet), and still more typically at least 0.75 square meters (8.33 square feet). The base portion 15 is typically generally circular or oval, but may take other convenient shapes.

The goal portion 20 further includes a generally hollow cylindrical portion 80 having an open proximal end 81 and a distal end 83 with an endless sidewall 84 extending therebetween and one or more (typically threaded) apertures 85 formed through the sidewall 84. One or more (typically matably threaded) locking members 90 extend through respective apertures 85 to engage an elongated member, such as a pole, extending into the cylindrical portion 80 through the proximal end 81. A plurality of support members or struts 95 extend from the sidewall 84 past the distal end and engage an annular ring portion 100. The support members 95 are typically connected at equidistant points around the cylinder portion 80 and ring portion 100. A net 105 is connected to the ring portion 100 to define a basketball goal or hoop. Typically, a cap portion 110 (also referred to as a cap, a capped distal end, a capped end, and the like) engages the distal end 83 to provide an additional barrier through to prevent further travel of an inserted pole or elongated member. The goal portion (excepting the net portion 105) is typically formed from one or more structural materials, such as steel, aluminum, composite materials, (fiber reinforced) graphite composite, cermets, or the like.

The system further includes an elongated member or pole 23 having a proximal end 115 for engaging the base portion 15 and a distal end 120 for engaging the goal portion 20. Typically, the pole portion 23 is cylindrical and more typically the pole portion 23 is hollow with a plurality of apertures 125 formed therethrough. In some embodiments, the pole portion includes a top portion 130 and a bottom portion 135 wherein one portion 130, 135 is hollow with an inner diameter slightly larger than the outer diameter of the other portion 135, 130, such that one portion 135, 130 may slide into the other portion 130, 135. The pole member is typically formed of a structural material, such as aluminum or steel.

Some embodiments of the system 10 include a ball return or guide portion 25 having a proximal end 150, a distal end 160 and a curved trough body member 165 extending therebetween. The proximal end 150 includes connecting members 170 for engaging the ring 100. The guide portion 25 is typically formed of a lightweight, semi-flexible material such as plastic, composite material, or the like.

In some embodiments, a padded base guard 30 (also referred to as skirt portion, slitted skirt portion, and the like) is included. The base guard 30 is typically a layer 180 of soft, resilient padding material sized and shaped to cover the base portion 15. Typically, the padding layer 180 is several inches thick and more typically includes a radial slit 185 extending from its outer perimeter 187 to a central aperture 190. The central aperture 190 is typically sized to allow passage of the pole 23 therethrough. Optionally, a generally rectangular elongated padding portion 195 may be provided to encircle the base portion 15, wherein the elongated portion 195 typically includes connectors, such as hook and loop portions, for forming the elongated rectangular portion 195 into a ring or loop as well as for connecting the elongated rectangular portion 195 to the padding layer 180.

In operation, the pole member 23 is inserted into the aperture 45, typically through annulus 50, and locking members 60 are (typically threadedly) inserted through apertures 65 to secure pole member 23 to base portion 15. Goal portion 20 is connected to pole member 23 by inserting distal end 120 into proximal end 81 and securing the pole member 23 in place by inserting locking members 90 through apertures 85 to engage pole member 23. Return portion 25 may be operationally connected to goal portion 20 by engaging connectors 170 to annular ring 100, and extending the curved trough portion 165 over cap 110 and/or distal end 83 and away from the net 105. Base guard portion 30 may be engaged over base portion 15 by moving pole member 23 through slit 185 until pole member 23 extends through central hole 190 and padded cover portion 180 generally overlaps top portion 40. Generally rectangular member may be extended around base portion 15 and fastened together and/or to padded cover portion 180 via connection members.

In one embodiment, base portion 15 and goal portion 20 are provided together as a kit. The kit typically includes guard portion 30, and may also include the return portion 25 and/or pole portion 23.

Figure 7A:
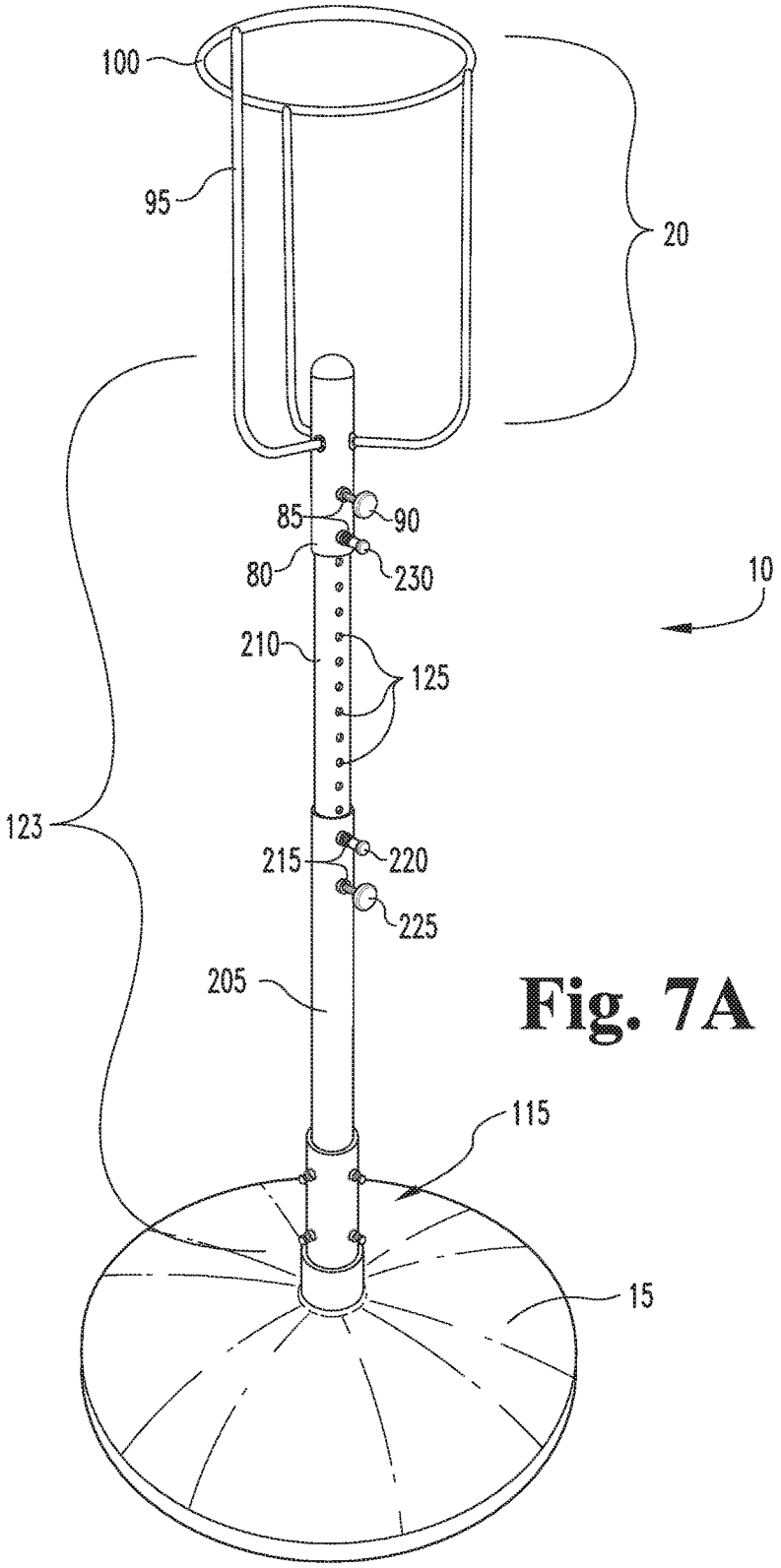
FIG. 7A is a perspective view of an alternative pole implementation of the embodiment of FIG. 1.
Figure 7B:
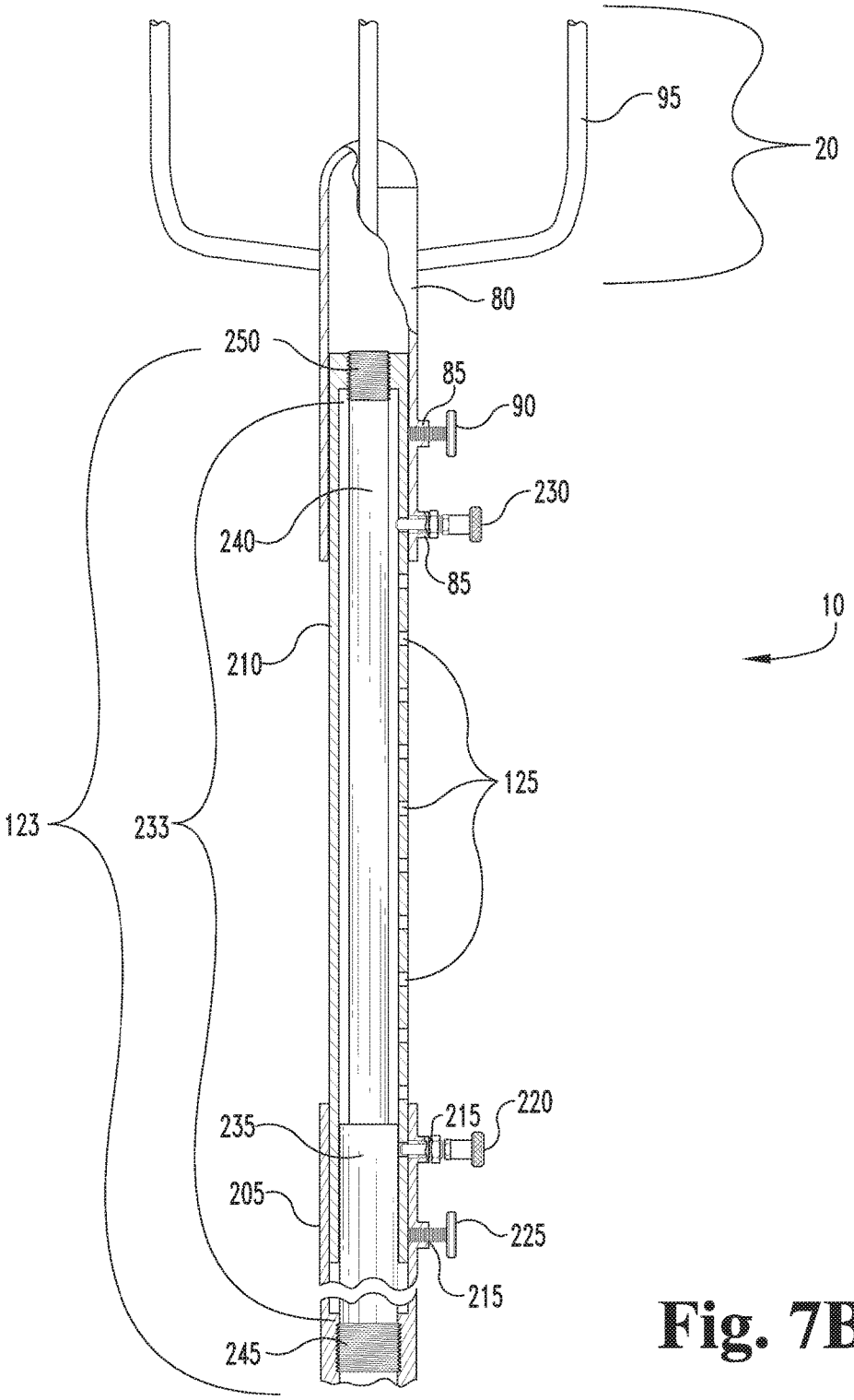
FIG. 7B is a cutaway view of the alternative pole implementation of FIG. 7A.

FIGS. 7A-7B depict another embodiment of basketball shot training system 10. FIG. 7A is a perspective view of an alternative pole implementation of the embodiment of FIG. 1. FIG. 7B is a cutaway view of the alternative pole implementation of FIG. 7A.

The FIG. 7A embodiment of basketball shot training system 10 typically may include base portion 15, goal portion 20, extending pole portion 123, cylindrical portion 80, goal member apertures 85, locking member 90, support member 95, support member 100, inner pole member apertures 125, outer pole member 205, inner pole member 210, outer pole member apertures 215, height adjustment member 220, pole outer locking member 225, torsion reduction member 230, gas spring 233 further including gas spring outer member 235, gas spring inner member 240, gas spring-outer wall interface 245, and gas spring-inner wall interface 250. These elements cooperate generally as described above, with differences discussed below.

Typically, base portion 15 operationally connects to extendable pole portion 123, which in turn operationally connects to goal portion 20. Such connections may be made, for example, by interference fit, threads, nipple connections, dowels, and/or the like. Pole portion 123 typically may include outer pole member 205 and which surrounds the exterior or inner pole member 210. The distance to which inner pole member 210 extends beyond outer pole member 205 typically may be controlled by operating height adjustment member 220, which typically may be a locking mechanism or fastener member (more typically a spring-actuated, rod locking mechanism) that passes through fastening apertures (specifically outer pole member apertures 215 and into inner pole member apertures 125) to restrict vertical movement of inner pole member 210. Additionally, pole outer locking member 225 typically may thread through outer pole member apertures 215 to interfere with inner pole member 210 such that inner pole member 210 may maintain a desired stability.

Inner pole member 210 typically may insert into cylinder portion 80. Cylinder portion 80 and goal portion 20 typically may be secured to inner pole member 210 by goal locking member 90, which typically may thread through goal apertures 85 to interfere with inner pole member 210 such that goal portion 20 may maintain a desired stability on inner pole member 210. Torsion reduction member 230 typically may be a locking mechanism (more typically a spring-actuated, rod locking mechanism) that passes through goal apertures 85 and into inner pole member apertures 125 to restrict torsional movement of cylinder portion 80 and goal portion 20.

Additionally, inner pole member 210 typically may be urged away from base portion 15 and beyond outer pole member 205 by gas spring 233 (or other suitable hydraulic, pneumatic, and/or like energy storage mechanism), typically including gas spring outer member 235, spring inner member 240, gas spring-outer wall interface 245, and gas spring-inner wall interface 250. Typically, the gas spring outer member 235 may connect to outer pole member 205 via gas spring-outer wall interface 245, and gas spring inner member 240 may connect to inner pole member 210 via gas spring-inner wall interface 250. Gas spring-outer wall interface 245 and gas spring-inner wall interface 250 typically may be threading, interference, and the like. Raising and lowering inner pole member 210 by gas spring 233 when height adjustment member 220 is retracted and pole outer locking member 225 do not interfere with inner pole member 210.

Typically, system 10 may be assembled by a user by threading (or otherwise connecting) gas spring 233 to opposing ends of the extendable pole portion 123. For example, this may be accomplished by connecting gas spring outer member 235 into outer pole member 205 at gas spring-outer wall interface 245 (which typically may be formed into outer pole member 205's wall) and then threading (or otherwise connecting) gas spring inner member 240 into inner pole member 210 at gas spring-outer wall interface 250 (which typically may be formed into inner pole member 210's wall). In this fashion, gas spring outer member 235 and gas spring inner member 240 typically reside completely or nearly completely within outer pole member 205 and inner pole member 210. Goal portion 20 typically may then be placed atop inner pole member 210 by inserting inner pole member 210 into cylinder portion 80. Locking member 90 and torsion reduction member 230 may then typically be engaged to interfere with inner pole member 210 through goal apertures 85. Inner pole member 210 typically may extend upwards due to the contained gas spring 233, but may then be compressed back down, typically using body weight or a user's pulling force or either goal portion 20 or inner pole member 210. Desired height of goal portion 20 and rim 100 may be set by engaging height adjustment member 220 and pole outer locking member 225 to interfere with inner pole member 210 through outer pole member apertures 215 and inner pole member apertures 125. Typically, goal locking member 90, height adjustment member 220, pole outer locking member 225, and/or torsion reduction member 230 do not directly contact or interfere with gas spring outer member 235 and/or gas spring inner member 240 to prevent marring of a gas spring surface.

In some implementations, gas spring 233 may not automatically urge goal portion 20 away from base portion 15. For example, gas spring 233 may be configured to maintain a neutral vertical position based on the load of goal portion 20 and inner pole member 210 by providing a counterbalancing upward force. In other implementations, gas spring 233 may provide a negative upward force, such that the goal portion 20 and inner pole member 210 slowly descend after goal portion 20 is raised.

In some other implementations, outer pole member 205 and inner pole member 210 may be circular, while in other implementations, outer pole member 205 and inner pole member 210 may be ovoid, square, triangular, and the like. Such a configuration may reduce the likelihood of a rotational event (i.e., where parts of system 10 rotate or pivot) when a ball strikes goal portion 20 or support members 95 when torsion reduction member 230 is not used. Such configurations may also be used to improve reflection capabilities, modify mass profiles, and/or the like.

Figure 9:
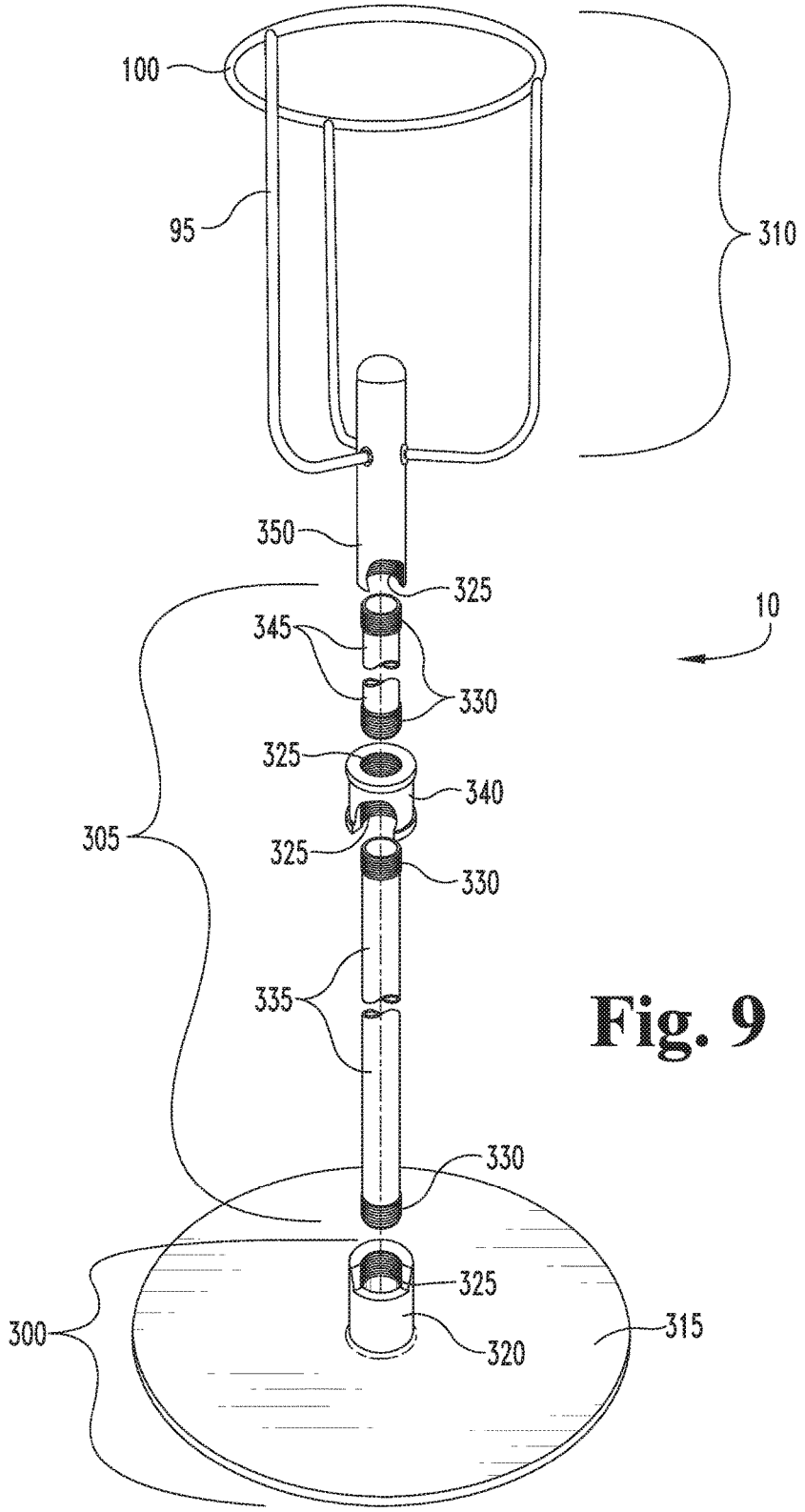
FIG. 9 is a perspective view of a second alternative pole implementation of the embodiment of FIG. 1.
Figure 10:
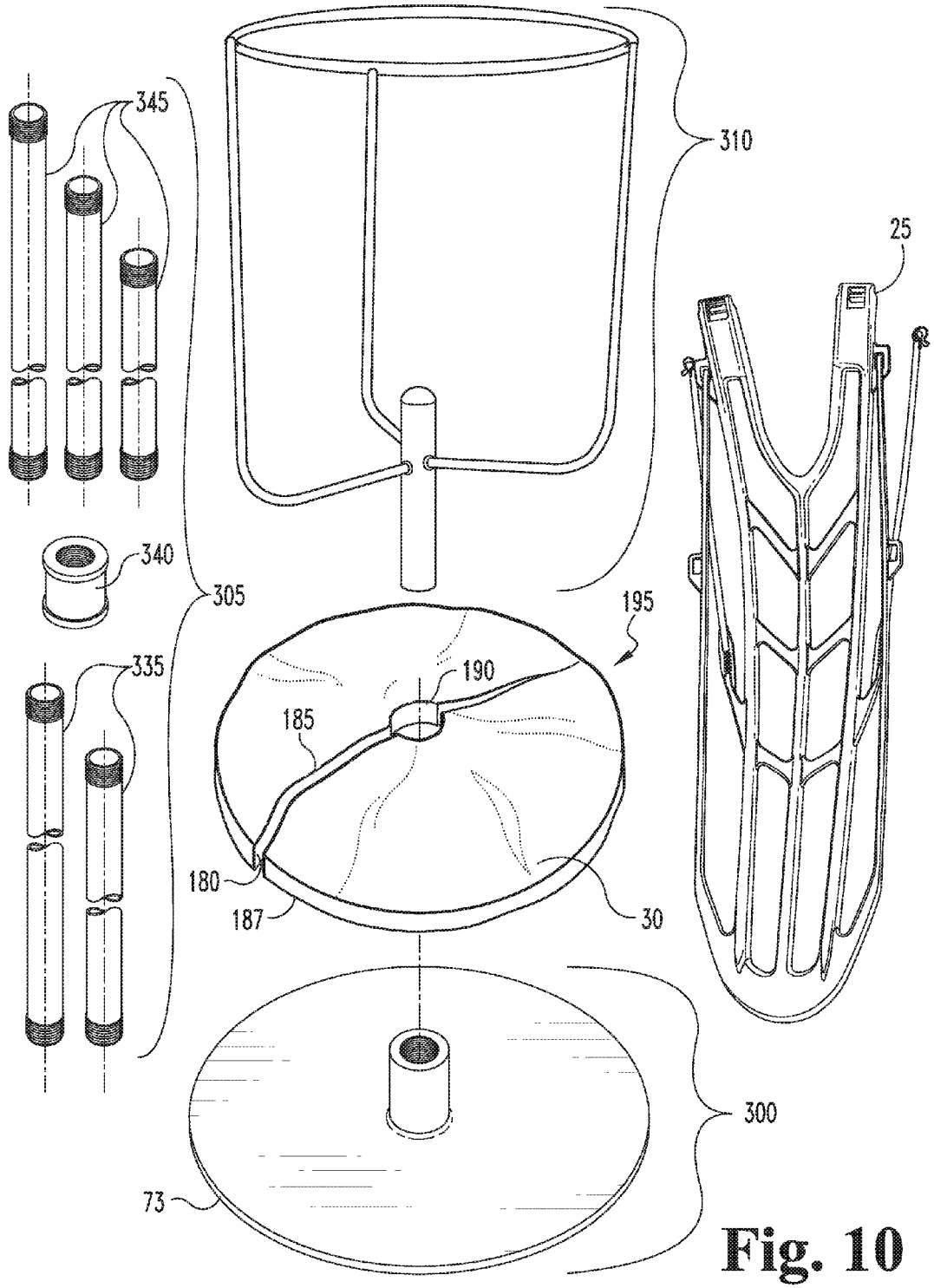
FIG. 10 is a perspective view of the kit members according to the embodiment of FIG. 9.

In other implementations, base portion 15 may be constructed using a high-density plate (or pancake) design (as depicted in FIGS. 9-10). Such material may be for example, but not limited to, steel, iron, lead, aluminum, silicon, concrete, high density plastics and/or polymers, and the like. In some implementations, the plate may be a weight-lifting plate, such as one or more forty-five pound weight plates. Such a design may allow for simpler assembly and more stable operation with a lower center of mass.

Additionally, in some implementations, the high-density plate or standard base portion 15 may be configured with a nipple and/or sleeve connection. In this configuration, outer pole member 205 may fit into the sleeve or interface with the nipple (e.g., via threading, dowel, interference fit, maze grooves, and/or the like) to connect extendable pole portion 123 to base portion 15.

Figure 8:
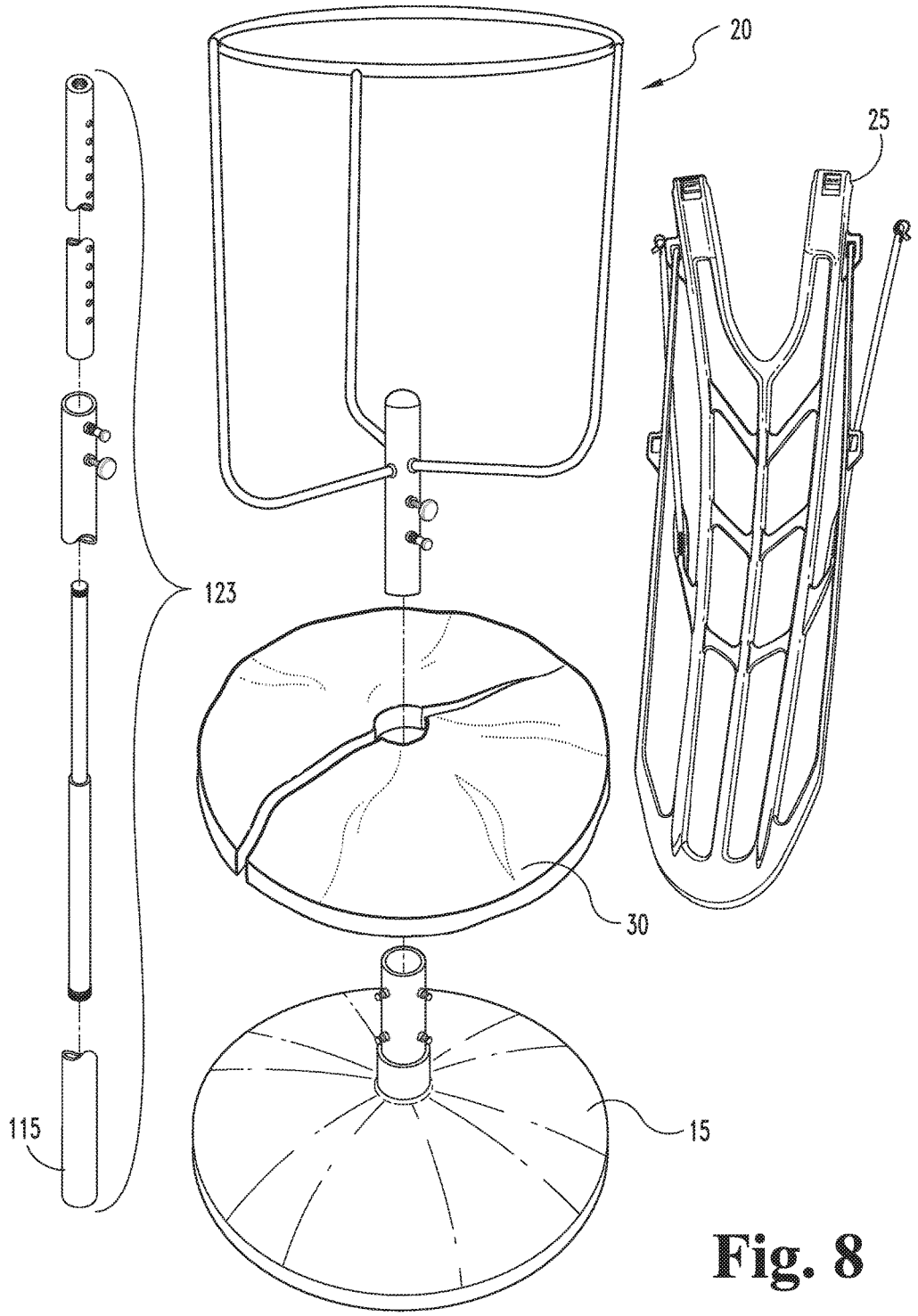
FIG. 8 is a perspective view of the kit members according to the embodiment of FIG. 7A.

In another embodiment, depicted in FIG. 8, base portion 15, goal portion 20, and extendable pole portion 123 are provided together as a kit. The kit typically may also include guard portion 30 and/or return portion 25.

In yet another implementation, as depicted in FIG. 9, system 10 may be constructed typically to include struts 95, rim portion 100, flat base portion 300, segmented pole portion 305, fastening hoop portion 310, flat base member 315, flat base sleeve 320, outer fastening interface 325, inner fastening interface 330, primary pole segment 335, pole coupling member 340, extension pole segment 345, and/or fastening cylinder wall 350. Flat base portion 300 typically may include flat base member 315, flat base sleeve 320, and/or outer fastening interface 325. Segmented pole portion 305 typically may include outer fastening interface 325, inner fastening interface 330, primary pole segment 335, pole coupling member 340, and/or extension pole segment 345. Fastening hoop portion 310 typically may include struts 95, rim portion 100, outer fastening interface 325, and/or fastening cylinder wall 350. Typically, flat base portion 300 may connect to segmented pole portion 305, and segmented pole portion 305 typically may then connect to fastening hoop portion 310.

When system 10 is assembled in this embodiment, flat base member 315 typically may rest on a flat surface (e.g., the ground, a driveway, a basketball court, and/or the like). Flat base sleeve 320 typically may be connected to flat base member 315 in a permanent (e.g., welded, soldered, and/or the like), semipermanent (e.g., crimped, threadlocked, and/or the like), temporary (e.g. threaded, coupled, interference fit, and/or the like), and/or a combination of the above fashions. Outer fastening interface 325 typically may be formed into flat base sleeve 320 and configured to receive inner fastening interface 330. Typically, such connection may be made by threading and/or coupling inner fastening interface 330 to outer fastening interface 325, but the connection may be made using any other interface mechanism. For example, outer fastening interface 325 and/or inner fastening interface 230 may include threads, couplers, adhesives, maze-like slotting/channels, magnets, and/or the like (and/or combinations thereof). In some further implementations, outer fastening interface 325 and/or inner fastening interface 230 may be configured to quickly disconnect. For example, outer fastening interface 325 and/or inner fastening interface 230 may include quick-pull pins, levered straps, and/or the like.

Further, segmented pole portion 305 typically may include inner fastening interface 330 at both ends of primary pole segment 335. Segmented pole portion 305 typically may attach to flat base portion 300 by connecting (e.g., adhering, threading, affixing, coupling, mating, and/or the like) one end of primary pole segment 335 having inner fastening interface 330 to outer fastening interface 325 of flat base sleeve 320. Pole coupling member 340 typically may also be formed with outer fastening interface 325 to receive the inner fastening interface 330 formed at the opposite end of primary pole segment 335. Extension pole segment 345 typically may also include inner fastening interface 330 at both ends of extension pole segment 345, one end connecting to outer fastening interface 325 of pole coupling member 340 opposite from primary pole segment 335.

Additionally fastening hoop portion 310 typically may attach to extension pole segment 345 via fastening cylinder wall 350, and fastening cylinder wall 350 may typically be formed with outer fastening interface 325. Outer fastening interface 325 typically may receive extension pole segment 345's end opposite the pole coupling member 340. Struts 95 typically may extend from fastening cylinder wall 350 in an outward and/or upward manner. Rim portion 100 typically may then be connected to struts 95 as described above.

Once assembled, flat base portion 300 typically maintains system 10 in an upright and stable manner, while segmented pole portion 305 and connected fastening hoop portion 310 extend vertically therefrom. Height adjustment typically may be accomplished by using varied sizes of extension pole segments 345. For example, primary pole segment 335, once attached to flat base portion 300 and pole coupling member 340, may extend to a height of 1.8 meters or six feet. A user may then attach a 0.3 meters (one-foot), 0.6 meters two-foot), and/or 0.9 meters (three-foot) extension pole segment 345 and fastening hoop portion 310 to result in rim portion 100 at a height of 2.4, 2.7, or 3.0 meters (eight, nine, or ten feet), respectively. In another implementation, primary pole segment 335 may be three feet in length and extension pole segment 335 may be provided in lengths of 0.15, 0.3, 0.6 and/or 0.9 meters (one-half, one, two, and/or three feet) to be used by shorter and/or younger individuals. The length, size, shape, and/or like attributes of flat base portion 300, segmented pole portion 305, and/or fastening hoop portion 310 structures may, of course, be modified for different scenarios, environments, and/or audiences.

In some implementations, the orientation and/or position of primary pole segment 335 and/or extension pole segment 345 may be reversed. For example, extension pole segment 345 may be connected to flat base sleeve 320 and pole coupling member 340, while primary pole segment 335 in turn connects to pole coupling member 340 and fastening cylinder wall 350.

Further, in some implementations, the orientation and/or position of outer fastening interface 325 and/or inner fastening interface 330 may be reversed. For example, flat base sleeve 320, pole coupling member 340, and/or fastening cylinder wall 350 may include inner fastening interface 330, while primary pole segment 335 and/or extension pole segment 345 may include outer fastening interface 325.

In some implementations, attachment via inner fastening interface 330 and outer fastening interface 325 may reduce and/or eliminate rotation and/or shifting of system 10 components (e.g., flat base sleeve 320, fastening cylinder wall 350, struts 95, rim portion 100, and/or the like). For example, when struck by a ball, strut 95 may transfer rotational force exerted by the ball upon the strut 95 through fastening hoop portion 310, segmented pole portion 305, and flat base portion 300, thus resisting fastening hoop portion 310 from spinning and/or vibrating.

In a further embodiment, depicted in FIG. 10, flat base portion 300, segmented pole portion 305, and/or fastening hoop portion 310 may be provided together as a kit. In some implementations, the kit typically may also include guard portion 30 and/or return portion 25. In some implementations, the kit may include one or more primary pole segments 335 of varying lengths (e.g., 0.9 meters (three feet), 1.5 meters (five feet), 2.1 meters (seven feet), and/or the like) and/or one or more extension pole segments 345 of varying lengths (e.g., 0.3 meters (one foot), 0.6 meters (two feet), 0.9 meters (three feet), and/or the like).

While the present novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the present novel technology are desired to be protected.

I claim:

1. A kit for assembling a basketball shot training system, comprising:

an elongated pole member;

a generally circular support base portion having a flat bottom portion with a surface area of at least 0.75 square meters, and a central aperture, a first cylindrical member connectable to the central aperture of the base portion for receiving the elongated pole member, and wherein the elongated pole member further comprises:

an inner pole member;

an outer pole member surrounding the inner pole member; and a gas spring disposed within the inner pole member and the outer pole member, wherein the gas spring further comprises a gas spring outer member operationally connectable to a gas spring inner member;

wherein the gas spring is operationally connectable to the inner pole member by a gas spring-inner wall interface, the gas spring-inner wall interface formed at least partially into the inner pole member; and wherein the gas spring is operationally connectable to the outer pole member by a gas spring-outer wall interface, the gas spring-outer wall interface formed at least partially into the outer pole member;

a goal member having a second cylindrical member with an open proximal end for receiving the elongated pole member, a capped distal end, an annular ring portion, a net portion operationally connectable to the annular ring portion, a plurality of support members secured to the second cylindrical member for supporting the annular ring portion and the net portion; and at least one goal portion aperture extending through the second cylindrical member;

at least one inner wall member aperture extending through the inner pole member;

at least one outer wall member aperture extending through the outer pole member; and at least one fastener member for extending through the at least one goal portion aperture for securing the goal member to the inner pole member.

2. The kit of claim 1, further comprising: a height adjustment member to pass through the at least one outer wall member and the at least one inner wall member to restrict vertical movement of the inner pole member.

3. The kit of claim 1, further comprising:

a return portion, wherein the return portion has a first end having connection members for attaching the return portion to the annular ring portion.

4. The kit of claim 1, further comprising:

a padded guard portion sized to cover the base portion.

5. A basketball training assembly kit, comprising:

an elongated member;

a support base operationally connectable to the elongated member, the support base further comprising a flat bottom member; a top member connectable thereto; and a central annulus extending from the top member for receiving the elongated member, wherein the elongated member further comprises:

an inner member;

an outer member surrounding the inner member and having a proximal end shaped to engage the central annulus; and a gas spring disposed within the inner member and the outer member, wherein the gas spring further comprises a gas spring outer member and a gas spring inner member disposed within the gas spring outer member;

wherein the gas spring is operationally connectable to the inner member by a gas spring-inner wall interface, the gas spring-inner wall interface defining threads extending partially through the inner member; and wherein the gas spring is operationally connectable to the outer member by a gas spring-outer wall interface, the gas spring-outer wall interface defining threads extending partially through the proximal end of the outer member;

a goal member, the goal member further comprising:

a generally hollow cylindrical member defining an open proximal end for receiving the inner member;

a capped distal end;

an endless sidewall extending between the generally hollow cylindrical member and the capped distal end;

an annular ring portion;

a plurality of support members secured to the endless sidewall for supporting the annular ring portion; and a net portion operationally connectable to the annular ring portion;

a slitted padded skirt sized to cover the support base and having a central hole shaped to accommodate extension of the elongated member therethrough; and a plurality of fastener members;

wherein the central annulus, the endless sidewall, the inner member, and the outer member each include a plurality of fastening apertures extending therethrough for engaging the fastener members.

6. The kit of claim 5, further comprising: a generally trough-shaped return member having a first end defining at least one connection member for attaching the return member to the annular ring portion.

7. The kit of claim 5, wherein each respective fastening member is at least partially threaded and wherein each respective fastening aperture is threaded to matably engage a respective fastening member.

8. The kit of claim 5, further comprising: an adaptor ring for insertion into the central annulus.

9. The kit of claim 5, wherein the flat bottom member has a surface area of at least 0.6 square meters.

* * * * *